United States Patent [19]

Hilbert

[11] 4,268,958

[45] May 26, 1981

[54] APPARATUS AND METHOD FOR COUNTING THE NUMBER OF SHAVES FOR WHICH A RAZOR BLADE IS USED

[76] Inventor: Ray Hilbert, 2085 Daisy Ave., Long Beach, Calif. 90806

[21] Appl. No.: 90,281

[22] Filed: Nov. 1, 1979

[51] Int. Cl.[3] ..... B26B 21/00

[52] U.S. Cl. ..... 30/34 A

[58] Field of Search ..... 30/34 A, 34 B; 116/DIG. 15

[56] References Cited

U.S. PATENT DOCUMENTS 2,827,872 3/1958 Thoma ..... 30/34 A

FOREIGN PATENT DOCUMENTS 2391038 1/1979 France ..... 30/34 A

*Primary Examiner*—Jimmy C. Peters

*Attorney, Agent, or Firm*—Fulwider, Patton, Rieber, Lee & Utecht

[57] ABSTRACT

A shaving implement is provided with a plurality of frangible tabs that can be broken off, one at a time, incident to each use of a razor blade for shaving. The user is able to keep track of the extent to which each blade is used, and to discard the blade after an appropriate number of uses.

2 Claims, 4 Drawing Figures

APPARATUS AND METHOD FOR COUNTING THE NUMBER OF SHAVES FOR WHICH A RAZOR BLADE IS USED

BACKGROUND OF THE INVENTION

1. Field of the Invention

The present invention relates to improvements in disposable razor blades and implements for the use thereof.

2. Description of the Prior Art

Currently, many razor manufacturers market disposable razors used by men for shaving facial hair and by women for shaving underarms and legs. Disposable razors are sold in several forms. In one implementation a razor blade is captured in a shaving implement which includes a molded plastic handle and blade holder. The blade itself is entrapped within the blade holder, but with an edge exposed at an angle relative to the plastic handle which is suitable for shaving. The manufacturers of such devices promote the sale of such implements as disposable devices, to be used for several shaves and then discarded.

An alternative shaving device involves a razor blade, or parallel set of blades, entrapped within a plastic cartridge. Again, the blades are disposed with sharp edges exposed at a suitable angle for shaving. The cartridges and blades therein are considered disposable, and are discarded after a suitable number of shaves. The cartridges are releasably mountable in a reusable razor blade handle.

Razor manufacturers today promote the sale of their shaving implements by extolling the superiority of their devices as contrasted with competitive shaving implements in terms of the number of times which blades of their manufacture can be used while still providing a smooth, close shave. Eventually, of course, the edges of all razor blades commercially available become degraded with continued use. The user ultimately discards the cartridge or disposable handle in which razor blades are captured and procures a new blade for further use.

Heretofore, there has been no provision to allow razor users to easily record and compare the number of satisfactory shaves that may be obtained from a particular blade. While sometimes a specific number, for example 10 shaves, are recommended for each razor by the manufacturer, in fact no simple system for easily maintaining a record of the number of satisfactory shaves achieved with a particular razor exists. As a consequence, consumers simply do not know the extent to which their shaving implement has been used. Users, for the most part, simply use a razor blade until the last use is inordinately uncomfortable, the razor having become dull from overuse. Cuts, scrapes and skin irritation frequently result from the use of a razor too long. Sometimes irritations of this type are not readily noticeable during the shaving process, but give discomfort subsequent to shaving.

SUMMARY OF THE INVENTION

The present invention is directed to an improvement in disposable razors used for shaving, and in the use of such razors. According to the invention, several manually frangible indicia are provided for each razor blade in association therewith. Such indicia may typically include a row of thin plastic tabs extending outwardly from the back of a shaving implement that includes a disposable handle. Where the disposable element is limited to a cartridge with blades carried therein, the frangible indicia may extend outwardly from the back of the cartridge.

According to the invention, several frangible indicia are secured proximate to a razor blade, typically through integral manufacture with a disposable handle or disposable cartridge. With each use of the blade for shaving, the user breaks one of the indicia, thereby recording a single instance of use of the blade contemporaneously therewith. With each use of the blade, the user breaks another one of the indicia. Once all of the tabs or other indicia are broken, the user is aware that the blade is probably no longer fit for use, and should be discarded.

The method and device of the present invention provide a number of advantages. The user is able to maintain a record of the number of times a razor has been used for shaving without the necessity for reference to anything other than the disposable portion of the shaving implement itself. That is, the user is able to physically feel and actually count the number of broken indicia or the number of indicia remaining. This number corresponds to the number of times that any particular razor has been used, and the number of times which the razor may subsequently be used, without the ill effects previously described. The user is able to ascertain this information not only after use of a blade for shaving, but also before each such use prior to incurring any of the discomfort that so typically arises from the use of a worn out blades.

A further advantage of the invention is that with a simple shave count recorded in association with each razor, the user need not separate partially used blades in any particular fashion. That is, where the user employs a number of disposable shaving implements in which the entire device is designed to be discarded after use, all such disposable razors may be kept in a single drawer or on a single shelf and razors nearing their useful life can be mingled with razors that have been used less frequently, or not at all. The user is able to tell at an instant the status of any particular razor by reference to the tabs, or other indicia remaining thereon.

A further advantage of the invention is that a user is able to obtain the maximum number of shaves from a particular razor without unknowingly exposing himself to the adverse effects of shaving with a dull razor. This number may vary from a manufacturer's recommended number, depending upon beard growth, frequency of shaving and facial sensitivity. Nevertheless, the number of useful shaves in razors of a particular type does not vary much for any single individual. The user is thereby able to correlate this knowledge with the number of unbroken tabs remaining on a razor handle or cartridge.

A further advantage of the invention is that a user is able to compare the number of useful shaves from razors marketed by different manufacturers. At the present, there is really very little reliable basis for comparison based upon past results, since there is currently no easily maintained system for recording the number of shaves which an individual is able to comfortably experience with a razor constructed by a particular manufacturer. With devices according to the present invention, however, the user is provided with a tabulated basis for comparison, and can govern future purchases of competitive shaving implements accordingly.

The invention may be explained with greater clarity and particularity by reference to the accompanying drawings.

DESCRIPTION OF THE EMBODIMENTS

Figure 1:
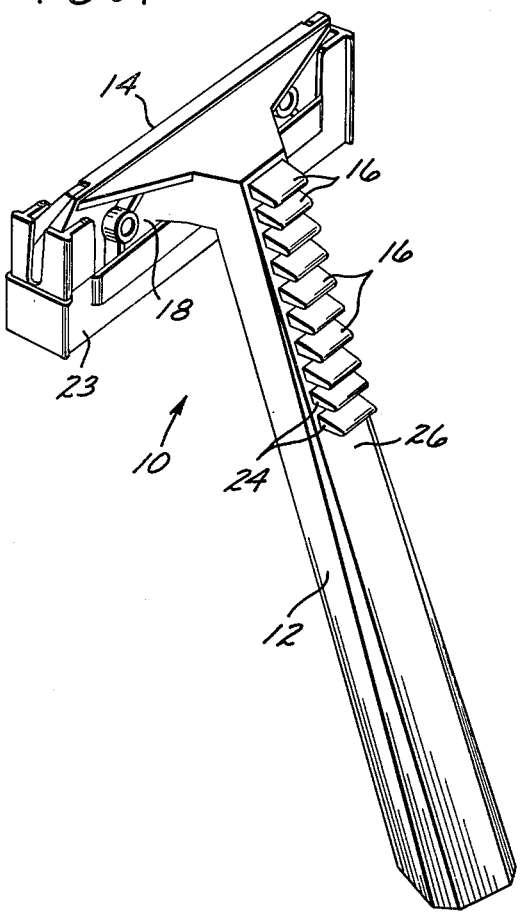
FIG. 1 is a perspective view of a disposable shaving implement according to the invention.

FIG. 1 illustrates a disposable razor 10 which is formed of molded plastic and includes a long, slender, hollow molded plastic handle 12 that extends longitudinally to facilitate gripping in a human hand. The razor 10 also includes a generally rectangular, transverse blade holder 14 located at one extremity of the handle 12. On the back of the shaving implement 10 a plurality of frangible indicia, in the form of breakable plastic tabs 16 are arranged linearly down the upper extremity of the handle 12.

The razor 10 is a molded plastic implement having a handle about 3 inches long and a transverse blade holder 14 centrally situated at the upper extremity of the handle 12 to form a generally T-shaped structure. The backside 18 of the blade holder 14 is integrally molded with the handle 12. A generally rectangular forward face plate 20 is also formed of plastic, but is glued or otherwise secured across the breadth of the blade holder 14 after insertion of a generally rectangular stainless steel razor blade 22, the sharp shaving edge of which is visible in FIG. 2. A transverse channel shaped blade guard 23 may be removably attached across the shaving edge of the razor 10, is indicated in FIG. 1. The entire shaving implement 10 is designed for use for an approximate number of shaves, after which it is to be discarded, since by that time the blade edge of the razor blade 22 will have become too dull for continued, comfortable use.

Figure 2:
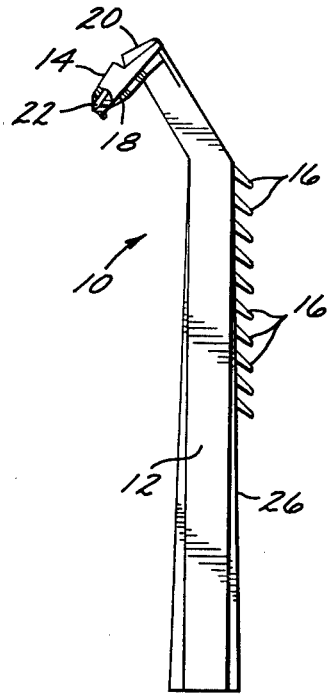
FIG. 2 is a side elevational view of the shaving implement depicted in FIG. 1.
Figure 3:
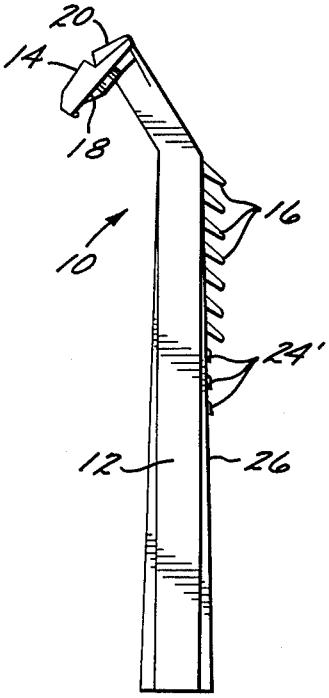
FIG. 3 illustrates the shaving implement of FIGS. 1 and 2 after partial use.

The tabs 16 are preliminarily affixed to the handle 12 and are integrally molded therewith. The tabs 16 extend transversely and are disposed in a line on the back surface of the longitudinally extending handle 12, and protrude outwardly therefrom at a sloping angle thereto, as illustrated in FIGS. 2 and 3. The tabs 16 are generally of triangular cross section, and the demarkations between the bases 24 and the back surface 26 of the handle 12 are fairly sharp. The tabs 16 therefore will readily fracture at their bases 24 under pressure on their tips, and leave only a slight stump or stub as illustrated at 24' in FIG. 3.

To use the razor 10, an individual grasps the handle 12 in one hand and positions the thumb of that hand upon the cantilevered extremity of the closest one of the tabs 16 remaining unbroken. That is, in fracturing the tabs 16 the user will progress from the grip end of the handle 12 toward the blade holder 14, as is apparent by the stumps 24' left at the lower extremity of the row of tabs along the handle 12, as depicted in FIG. 3.

The user is able to accurately and easily record and maintain a record of the number of times the razor blade 22 is used for shaving by breaking away one of the tabs 16 immediately prior to or subsequent to each instance of use of the blade for shaving purposes. The user is thereby able to determine with considerable facility the number of additional shaves which he will be likely to comfortably obtain from the razor 10, based upon the number of stumps or stubs 24', the number of tabs 16 remaining unbroken, and past experience as to the number of comfortable shaves which he is likely to obtain from a razor of the type depicted at 10 in FIGS. 1–3.

Figure 4:
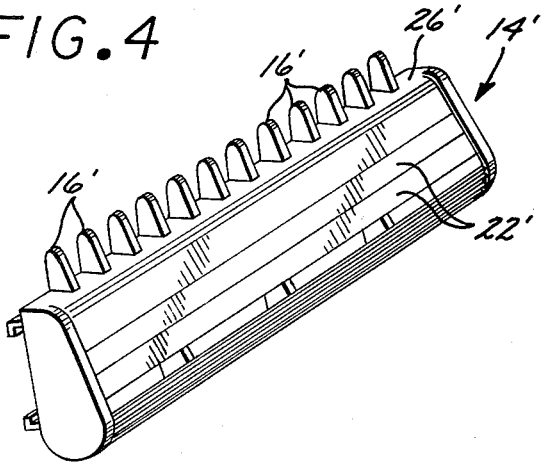
FIG. 4 is a perspective view of an alternative embodiment of the invention.

A user can utilize a cartridge 14' depicted in FIG. 4, with sets of parallel blades 22' secured therein in the same fashion. The cartridge 14' is not integrally formed with a handle, but instead is releasably secured to a conventional reusable handle of a configuration similar to that of the handle 12 in the embodiment of FIGS. 1–3. As with the embodiment of FIGS. 1–3, the user exerts pressure on the cantilevered tips of the tabs 16' to break those tabs off at their bases adjacent to the upper surface 26' of the cartridge 14'. With each shave, the number of tabs 16' remaining and the number of stubs or stumps left from the broken tabs provide the user with a basis for ascertaining the number of times the razor cartridge 14' has been used for shaving, and therefore the expected number of satisfactory shaves remaining before the blades 22' become too dull for further use.

Other embodiments of the invention will undoubtedly readily occur to those familiar with shaving devices. For example, many older style shaving implements employ a reusable handle and blade holder with a screw mechanism for opening the blade holder and closing it with each change of disposable blades. In such an arrangement, a disposable sleeve can be fashioned to carry frangible tabs of the type depicted in the preferred embodiments illustrated in the drawings. Such tabs can be broken one at a time in association with use of the shaving implement with each razor blade. A user can thereby maintain a record of uses in the same fashion as with the disposable razor 10 or the disposable cartridge 14'. With each change of blades in such a razor, the user removes the old sleeve and replaces it with a new one.

Accordingly, because of the many possible variations of the invention, the scope of the invention should not be considered as limited to the specific embodiments depicted and methods of use described in detail. Rather, the proper scope to be accorded to the invention is defined in the claims appended hereto.

I claim:

1. In a disposable razor having molded plastic handle with front and back surfaces and a blade holder within which a razor blade is captured, the improvement comprising a plurality of separate, manually frangible, thin plastic tabs all having bases and cantilevered tips protruding outwardly from said back surface of said handle at a uniform sloping angle thereto away from said blade holder, and said tabs are arranged in a row along the back surface of said handle with sharp demarkations defined between said bases and said back surface of said handle.

2. A method of recording the number of uses of a disposable razor having a molded plastic handle with front and back surfaces and a blade holder within which a razor blade is captured, the improvement comprising a plurality of separate, manually frangible, thin plastic tabs all having bases and cantilevered tips protruding outwardly from said back surface of said handle at a uniform sloping angle thereto away from said blade holder, said tabs being arranged in a row along the back surface of said handle with sharp demarkations defined between said bases and said back surface of said handle, comprising grasping said handle in one hand, positioning the thumb of that hand upon the cantilevered tip of one of said tabs, and exerting pressure with said thumb toward said handle on the tip positioned thereagainst until said tip fractures and breaks away from said handle.

* * * * *